United States Patent [19]

Caroff

[11] 3,981,209

[45] Sept. 21, 1976

[54] GRIPPING PINCERS

[75] Inventor: Yves Robert Caroff, Saint-Mande, France

[73] Assignee: Facom, Morganis, France

[22] Filed: July 10, 1974

[21] Appl. No.: 487,044

[30] Foreign Application Priority Data

July 20, 1973 France ..... 73.26805

[52] U.S. Cl. ..... 81/367; 30/262

[51] Int. Cl.[2] ..... B25B 7/12

[58] Field of Search ..... 81/367–395, 81/405; 30/262, 296 A, 231, 271

[56] References Cited

UNITED STATES PATENTS

| | | | |
|---|---|---|---|
| 2,543,922 | 3/1951 | Mead | 81/379 X |
| 2,672,778 | 3/1954 | Jones | 81/377 X |
| 2,777,347 | 1/1957 | Sendoykas | 81/385 X |
| 2,981,133 | 4/1961 | Campman et al. | 81/428 R X |
| 3,733,627 | 5/1973 | Epstein | 7/5.4 |
| 3,831,207 | 8/1974 | Boyajian | 7/5.5 |

FOREIGN PATENTS OR APPLICATIONS

| | | | |
|---|---|---|---|
| 1,100,105 | 3/1955 | France | 81/367 |
| 81,940 | 8/1919 | Switzerland | 30/262 |
| 960,485 | 6/1964 | United Kingdom | 30/262 |

*Primary Examiner*—James L. Jones, Jr.
*Attorney, Agent, or Firm*—Eric P. Schellin

[57] ABSTRACT

The pincers is of the vice-pincers type and comprises a main lever and a fixed jaw integral with the main lever. A pivotable jaw is pivoted to the main lever and a toggle device connects the pivotable jaw to another part of the main lever. The feature of the pincers is that the toggle device comprises an auxiliary lever pivoted to the pivotable jaw and performing the function of a lever for locking the pincers and a lever of adjustable length which is pivoted at one end to the auxiliary lever and at the opposite end to the main lever.

4 Claims, 17 Drawing Figures

GRIPPING PINCERS

The present invention relates to gripping pincers of the type termed "vice pincers" comprising a main lever with which is integral a first fixed jaw, a second jaw being pivotably mounted on said main lever and being connected at a second point of said main lever by a toggle device constituting both an auxiliary actuating lever and a device locking the two jaws in the gripping position by its jamming against the main lever.

A number of pincers of this type are known among which there may be mentioned that described in French Pat. No. 1,100,105.

The essential features of this pincers reside in the fact that the bearing point of the toggle device on the main lever is adjustable and, secondly, the pivot axis of the pivoting jaws is also transversely adjustable on the main lever.

The toggle device is locked when the pivot axis of the bearing point of the toggle device on the main lever, the pivot axis of the two branches of the toggle device and the pivot axis of the pivotable jaw on the auxiliary shifting lever are in alignment with each other.

It is even preferable, to ensure a positive locking, that the pivot axis of the two branches of the toggle device be slightly offset in the direction of the main lever with respect to the straight line through the two other aforementioned axes. Such a passage through this straight line of the pivot axis of the two branches of the toggle ensures a good locking but renders the unlocking of the pincers awkward so that it is necessary to provide an unlocking device pivoted to the free end of the auxiliary shifting lever and provided with a heel which, by bearing against the branch of the toggle connected the main lever to the auxiliary lever, causes the displacement of the pivot axis of the two branches of the toggle in the opening direction.

Such an arrangement considerably increases the price of the pincers.

An object of the invention is to remedy the aforementioned drawbracks by providing a gripping pincers which is simple in construction, does not require an unlocking lever and is easy to handle and adjust while costing less than known pincers of this type.

According to the invention, there is provided a gripping pincers of the type termed vice-pincers comprising a main lever with which is integral a first fixed jaw, a second jaw being mounted on said main lever to pivot about a pivot axis and connected at another point of said main lever by a toggle device, wherein the toggle device comprises an auxiliary lever pivoted to said second jaw and performing the function of a locking lever of the pincers, and a lever of adjustable length having one end pivoted to said auxiliary lever and another end pivoted to said main lever.

According to a first particular feature of the invention, the lever adjustable in length comprises at least one screwthreaded rod pivoted to said main or auxiliary lever and cooperating with an internally screwthreaded tubular member which is pivoted to the other lever but freely rotable with respect to its pivotable connection. In order to render the pincers still further effective and easy to handle and to reduce its overall size, it is advantageous to arrange in accordance with another feature of the invention that said pivotable jaw be pivoted to the auxiliary lever through a heel which is integral with said jaw and offsets this pivotal connection beyond the pivot axis of the jaw on the main lever with respect to the actice end of the jaw. Owing to this feature, it is in particular possible to increase the efficiency of the gripping achieved by the locking of the toggle while requiring on the part of the user only minimum effort for achieving this locking.

According to another feature of the invention, means may be provided for suitably regulating the gripping force, this means being mounted on said lever of adjustable length and limiting in an adjustable manner and in cooperation with an abutment provided on said auxiliary lever, the tensioning of the toggle formed by this lever and said pivotable jaw.

These regulating means are formed for example by a preferably detachable sleeve slidably mounted on said lever of adjustable length and having an axially variable outside diameter.

Further features and advantages of the invention will be apparent from the ensuing description with reference to the accompanying drawings.

Figure 1:
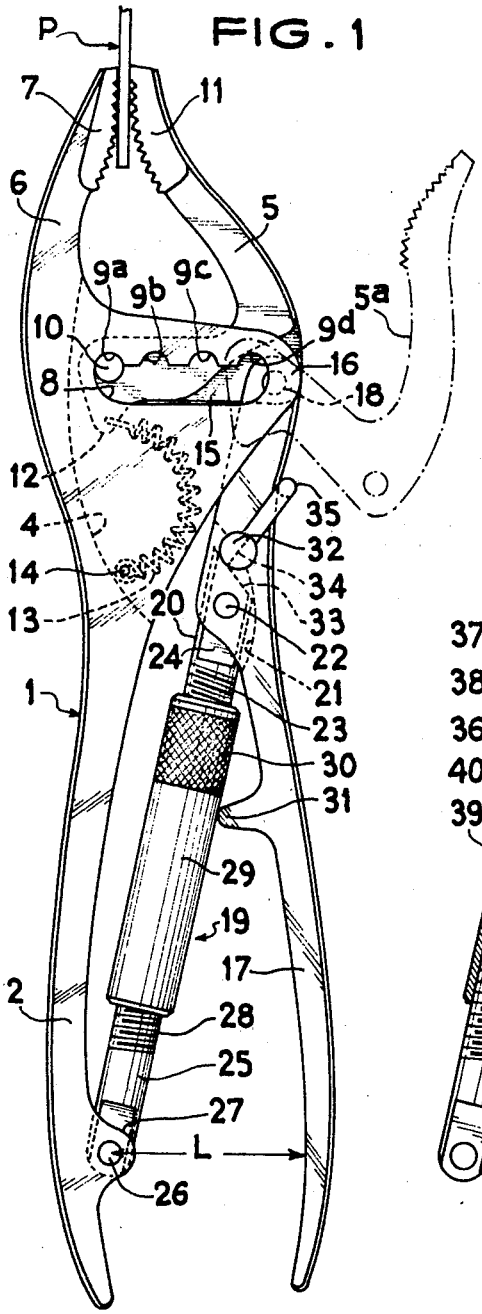
FIG. 1 is a plan view of a gripping pincers according to the invention.

The gripping pincers shown in FIG. 1 comprises a main lever 1 formed by a cast or forged steel member. This lever has three parts, namely a rear part 2 which constitutes one of the grips of the pincers, a wider intermediate part 3 in which is milled a fork 4, which constitutes a part for the pivotal connection of a pivotable jaw 5, and a front part 6 which constitutes the fixed jaw of the pincers. Provided at the end of this fixed jaw 6 is a chop 7 which is integral with the whole of the lever 1. The active surface of the chop 7 preferably has transverse grooves.

In the intermediate part 3 of the main lever 1 the branches of the fork 4 carry in facing relation two elongated openings 8 which are transversal in that they extend in a direction substantially perpendicular to the direction in which the chop 7 extends.

The longitudinal edge of each opening 8 adjacent the chop 7 is provided with a series of notches **9*a* to 9*d*** having the shape of an arc of a circle.

In the two openings 8 there are disposed the two ends of a cylindrical journal 10 which has a radius which is equal to the radius of the notches 9*a* to 9*d* and at the most equal to one half the minimum width of the openings 8. The journal 10 is preferably a tight fit on the end of a branch of the pivotable jaw 5 which has the shape of a V. The end of the other branch of the jaw 5 carries a second chop 11 which is integral therewith and adapted to cooperate with the fixed chop 7.

The active surface of the chop 11 also has transverse grooves provided preferably on a convex surface.

The thickness of the pivotable jaw 5 is equal (apart from a very slight clearance) to the distance between the inner surfaces of the branches of the fork 4 of the lever 1. The branch of jaw 5 carrying the journal 10 comprises on its outer edge and substantially in the region of this journal a projection 12 to which a spring 13, adapted to be sujected to bending stress, is hooked. The opposite end of this spring 13 is hooked to a pin 14 fixed to the rear part of the branches of the fork 4 at a distance from the projection 12 which is less than the length of the spring so as to impart to the latter the shape of an arc of a circle.

Under the action of the spring 13, the pivotable jaw 5 therefore tends to pivot on the lever 1 about the axis of the journal 10 in the direction for opening the pincers. Further, the spring 13 owing to its tendency to resume its normal rectilinear shape biases the journal 10 in contact with the two notches, for example notches 9*a* in which it is engaged.

In the vicinity of its corner, that is to say the connection of its two branches, the pivotable jaw 5 has a portion 15 of reduced thickness defining the region receiving two branches of a fork 16 provided at the end of a lever 17 which is also constructed of cast or forged steel.

This fork 16 which extends between the two branches of the fork 4 of the main lever 1, is pivoted to the pivotable jaw 5 by a pivot pin 18.

The lever 17 constitutes one of the branches of a toggle formed by this lever an a lever 19 of adjustable length which contitutes the device for regulating the distance between the jaws of the pincers in any given position of the journal 10 in the notches 9*a* to 9*d* of the openings 8.

In the embodiment shown in FIG. 1, the lever 19 has three parts. A first rod 20 is pivoted to the auxiliary lever 17 in a fork 21 facing the main lever 1 by a pin 22. The rod 20 carries a lefthand screwthread 23. Two flat surfaces 24 are provided on the end portion of the rod 20 engaged in the fork 21. A second rod 25 is pivotably mounted at one end by a pin 26 in a fork 27 provided at the end of the grip part 2 of the main lever 1. The rod 25 carries a righthand screwthread 28.

The rods 20 and 25 are interconnected by a tubular member 29 carrying internal screwthreads adapted to cooperate with the screwthreads 23 an 28 of the rods 20 and 25.

The tubular member 29 has on its end part screwed on the rod 20 a knurled portion 30.

The auxiliary lever 17 has at roughly one third of the distance between the pin 22 and its rear end an abutment 31 adapted to bear against the tubular member 29 so as to limit the movement of the levers 20 and 1 toward each other when closing the pincers.

In the embodiment shown in FIG. 1, the abutment 31 is constituted by a projection integral with the auxiliary lever 17 but it will be understood that it is possible to replace this projection by a pin having an adjustable position screwed in the lever 17.

The auxiliary lever 17 is provided with locking bolt which includes a cylindrical pin 32 which is rotatable in an aperture formed in the lever 17 and extends at least partly into the fork 21. This pin cooperates with a nose portion 33 at the end of the rod 20 so as to lock the latter. The pin 32 has, in the part thereof between the branches of the fork 21, a notch 34 which, when it is facing the nose portion 33, allows the free passage of the end of the rod 20 in the fork. A staple 35 is provided for modifying the position of the pin so that the latter can lock or release the rod 20.

Figure 2:
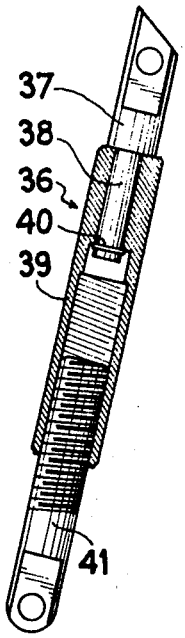
FIG. 2 is a view of a modification of the lever of adjustable length ensuring the adjustment of the distance between the jaws of the pincers according to the invention.

In FIG. 2 there is shown a first modification of the lever of adjustable length 19 shown in FIG. 1. This lever 36 has in the same way as the lever 19, three parts. A rod 37 is pivoted to the auxiliary lever of the pincers in the manner shown in FIG. 1 however instead of carrying a screwthread, this part has an extension 38 of reduced diameter which is engaged in an aperture provided at the end of the tubular member 39 and is maintained in this aperture by a circlip 40. The tubular member 39 can rotate freely with respect to the rod 37. In the part thereof opposed to the aperture the tubular member 39 is internally screwthreaded and cooperates with a screwthreaded rod 41 pivoted to the main lever 1 in the same manner as the rod 25 shown in FIG. 1.

Before describing the operation of the pincers described with reference to FIG. 1, it will be first mentioned how the length of the lever 19 of the toggle is adjusted in accordance with the thickness of a part P to be gripped, bearing in mind the position of the journal 10 is one of the sets of notches of the openings 8, so that when the two chops 7 and 11 are applied against the part, the axis of the pin 22 about which the lever 29 pivots with respect to the auxiliary lever 17 can be brought into alignment with the axes of the pins 18 and 26, or shifted slightly beyond the line joining the pins 18 and 26, so as to ensure a jamming of the toggle.

This adjustment corresponds in practice to a certain angular pivotal movement ot the lever 17. The abutment 31 of the lever 17 is brought in contact with the surface of the tubular member 29 of the lever 19. By construction, the axes of the three pins 18, 22 an 26 are then in alignment.

The pincers is engaged on the part P for the thickness of which the adjustment must be made. The tubular member 29 is rotated by acting on its knurled portion 30 in the direction for extending the length of the lever 19 which applies the chops against the part P. This operation is rendered rapid owing to the screwthreads of opposite hand on the rods 20 and 25. The position thus reached does not permit the locking since the three journals are still in alignment.

The pincers is then opened a little by acting on the lever 17 and, with the pincers maintained in this positions, the tubular member 29 is rotated in the direction for closing the toggle. This operation is stopped when the contact between the chops of the pincers and the part P is resumed.

Thenceforth, the toggle can be jammed by bringing the three pins 18, 22 and 26 into alignment and even beyond the position of alignment for the axis of the centre pin 22 so as to ensure a safe locking.

Il will be understood that to ensure the gripping of a part of different thickness the aforementioned adjustment must be modified.

The maximum capacity of the pincers is shown in FIG. 1 in dot-dash line. The position 5*a* of the jaw 5 is reached by placing the journal 10 in the notches 9*d* of the openings 8 and in shortening to the maximum extent the lever 19 of adjustable length.

Having thus adjusted the lever, the operation of the pincers shown in FIG. 1 is as follows; when the levers 1 and 17 are not urged toward each other they are moved away from each other under the action of the spring 13 which also shifts the pivotable jaw 5 in the direction for opening the pincers.

In starting from this open position, for gripping a part it is sufficient to bear on the two levers 1 and 17 so as to move towards each other. The toggle opens by bearing against the pin 26 and this urges the pin 18 to rise and the jaw 5 to rotate about the journal 10 in the direction for moving the chops 7 and 11 towards each other until they are applied against the part P and the toggle is in the jammed position. This position is reached when the abutment 31 of the lever 17 comes in contact with the tubular member 29 of the lever 19 of the toggle.

It could happen that the abutment 31 of the lever 17 comes in contact with the member 29 of the adjustable lever 19 when the pins 18, 22 and 26 are not in alignment, in which case the locking of the pincers is not ensured.

In order to hold the pincers stationary in the gripping position, the staple 35 of the locking device is acted upon in such manner as to present to the nose portion 33 of the rod 20 the solid part of the pin 32 so that any movement of rotation of the rod 20 about the pin 32 is prevented and thus ensures the locking of the pincers.

To open the pincers, the toggle must be closed. This is achieved by merely pulling on the lever 17 so as to displace the pin 32 in the direction to move it away from the main lever 1 without requiring the intervention of an additional unlocking lever as is the case in particular in the pincers described in the aforementioned French Patent.

Such a result is achieved owing to the precision with which it is possible to obtain the alignment of the pins 18, 22 and 26 since the levers 1 and 17 and the jaw 5 are solid cast or forged elements.

The gripping pincers according to the invention has a number of advantages over known pincers of this type and in particular over the pincers described in the aforementioned French Patent.

The knurled portion 30 of the tubular member 29 is in the vicinity of the jaws of the pincers and this permits, when holding the pincers in the palm of the hand with the last three fingers applied on the ends of the grips, acting on the knurled portion 30 with the thumb and the index finger. The user can therefore take hold of and adjust the pincers in one hand.

Moreover, the position of the member 29 between the two levers 1 and 17 facilitates the handling of the pincers whether it be the lever 1 or the lever 17 which is held in the palm of the hand.

The distance L between the pin 26 and the auxiliary lever 17 is constant irrespective of the position of the journal 10 in the notches 9*a* to 9*d* of the openings 8 and this increases the convenience of the handling of the pincers.

The levers 1 and 17 and the pivotable jaw 5 are preferably of cast or forged steel. This permits forming the chops 7 and 11 in one piece with the lever 1 and the jaw 5 respectively.

This manner of manufacturing was not possible for the known pincers whose levers were constituted by U-section blanked and formed sheet metal to which the chops had to be secured.

The fact of forming the chops in one piece with the jaws of the pincers permits reducing the overall size of the nose portion for a capacity and strength at least equivalent to those of pincers having attached chops.

The precision with which the pins 18, 22 and 26 are aligned permits achieving the locking of the pincers when these pins are in alignment.

In a conventional pincers constructed from folded and formed sheet metal, bearing in mind the manufacturing tolerances, the pivot axis of the two branches of the toggle must pass sufficiently beyond the line connecting the axis of the pivotal connection of the pivotable jaw to the auxiliary lever and the axis of the pivotal connection of the other branch of the toggle to the main lever to prevent an undesired automatic unlocking. Consequently unlocking means must be provided to unlock the pincers.

Such unlocking means are unnecessary in the pincers according to the embodiments described which may be unlocked by directly pulling on the auxiliary lever, such as the lever 17 of the pincers shown in FIG. 1.

The levers of the pincers, and in particular the levers 1 and 17 of the pincers shown in FIG. 1, are preferably made from cast or forged steel and their section may be relatively small and this reduces the weight of the pincers and imparts to the levers a certain resilience.

The resilience of the main lever is made use of when adjusting the spacing between the chops of the pincers. Indeed, if in the course of this adjustment the lever 19 is given a length slightly greater than the length required for obtaining the locking of the pincers by acting on the tubular member 29 in the course of the moving together of the levers 1 and 17, the lever 19, which bears, on one hand, against the pin 26 mounted on the fork 27 of the main lever 1 and, on the other hand, against its pin 22 of the pivotal connection to the lever 17, produces through the latter and the branch of the jaw 5 which carries the journal 10, a slightly elastic deformation of the main lever 1 and thus allows the pins 18, 22 and 26 to come into alignment and lock the pincers.

With reference now to FIGS. 3 to 7, there will be described a second embodimennt of the invention which has the advantages described herein before with respect to FIGS. 1 and 2 and includes improvements in particular as concers handling and overall size of the pincers. Broadly speaking, this pincers is similar to that shown in FIGS. 1 and 2. It consequently comprises a main lever 1 having three parts. A rear part 102 constitutes one of the grips of the pincers, a widen intermediate part 103, in which is formed by a milling operation of a fork 104, constitutes the part for pivotably mounting a pivotable jaw 105, and a front part 106 constitutes the fixed jaw. Provided at the end of this fixed jaw 106 is a chop 107 which is integral with the whole of the lever.

In the intermediate part 103 of the main lever 101, the branches of the fork 104 carry in facing relation two elongated openings 108 provided with a series of notches 109 each having the shape of an arc of a circle.

Disposed in the two openings 108 are two ends of a journal 110 which is preferably a tight fit in the end of a branch of the jaw 105. The end of another branch of the jaw 105 carries a second chop 111 which is integral therewith and is adapted to cooperate with the fixed chop 110.

The branch of the jaw 105 in which the journal 110 is engaged has on its outer edge, and substantially in the region of the journal, a projection 112 to which is hooked a spring 13 adapted to be subjected to bending stress. The opposite end of the spring 113 is hooked to a pin 114 secured to the rear part of the branches of the fork 104 at a distance from the projection 112 less than the length of the spring so as to impart to the spring the shape of an arc of a circle.

A lever 115 constitutes one of the branches of a toggle comprising this lever and a lever 116 of adjustable length which has three parts. A first part 117 is pivoted by a pin 119 to the auxiliary lever 116 in a fork 118 facing the main lever 101. The part 117 has a cylindrical portion 120 integral with an ear 121 pivoted to the pin 119. The cylindrical portion 120 is rotatable in second tubular member 122 which has an inner screwthread cooperating with a third element 123 or screwthreaded rod. The latter is pivotably mounted on a pin 124 mounted in a fork integral with the main lever 102. Thus the length of the lever 116 can be adjusted by rotating the tubular member 122.

The pivotable jaw 105 has a heel 125 which is pivotably mounted on a pin 126 of a fork 127 provided at one end of the auxiliary lever 115 beyond the fork 118 to which the adjustable lever 116 is pivoted. The heel 125 substantially extends the branch of the jaw 105 which comprises the chop 111 and offset a distance *d* the pin 126 beyond the pin 110 of the pivotal connection of the jaw 105 to the main lever 101 with respect to the branch of this jaw which has the chop 111.

The auxiliary lever 115 has, at roughly one quarter of the distance between the pivotal connection of the rod 117 and its rear end, an abutment 128 adapted to bear against the tubular member 122 so as to preclude the levers 115 and 101 from moving too close together when closing the pincers.

The tubular member 122 has externally a knurled portion 129 and a hexagonal portion 130 the latter enabling it to be rotated by means of a spanner under certain conditions of operation described hereinafter. It also has a graduation 131 at the end thereof adjacent the member 117, the latter having a corresponding index or reference 132 (FIGS. 5 to 7).

Two detachable means are engaged on the tubular member 122. The first is a sleeve 133 which is axially split and has a ridge 134 and a portion 135 of smaller diameter. This sleeve is slidably mounted on a tubular member 132 and constitutes means for regulating the gripping effect of the pincers. The other detachable means is a knurled ring 136 which is capable of being locking to the tubular member 122 by a screw. This ring is adapted to facilitate acting on the tubular member since, as it has a larger diameter, this ring enables the user to exert a higher rotating torque on the tubular member 122 so that in some cases a spanner is unnecessary. For the same purpose, the tubular member may be provided with a plurality of transverse apertures 137 adapted to receive an auxiliary rod (not shown) which replaces the spanner.

Note that the means 132 and 136 are detachable and can therefore be provided as optional equipment for the pincers, the mounting of these means being very conveniently achieved by completely unscrewing the tubular member 122 from the rod 123.

Figures 3, 4, 5, 6, 6A, 7:
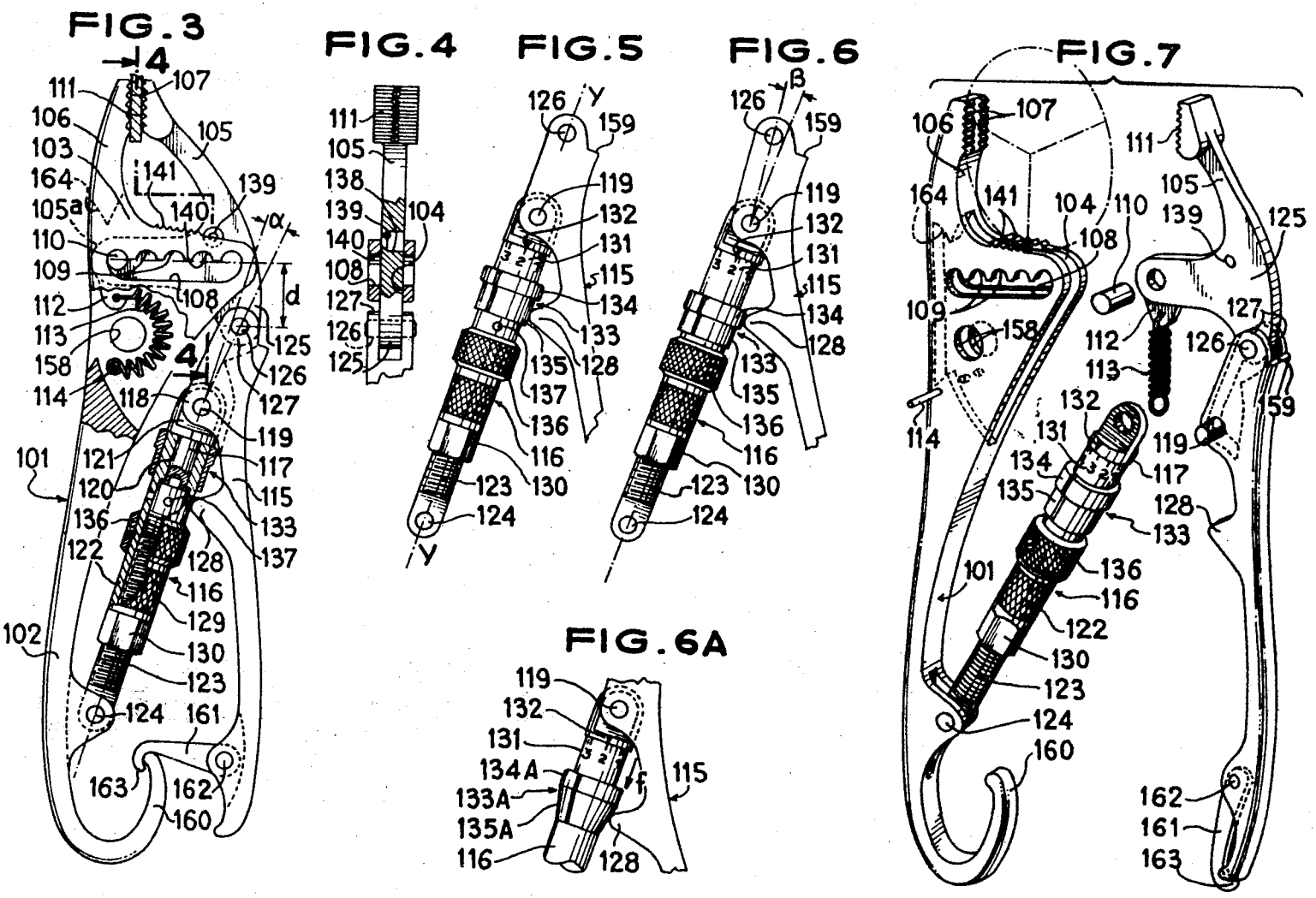
FIG. 3 is a plan view, partly in section, of a gripping pincers according to another embodiment of the invention.
FIG. 4 is a sectional view of a part of the pincers shown in FIG. 3 in a plane perpendicular to the plane of this FIG. 3.
FIGS. 5 and 6 are partial views of the lever of adjustable length of the pincers provided with means for regulating the gripping force placed in different positions.
FIG. 6A is a view of a modification of the means for regulating the gripping force.
FIG. 7 is an exploded view of the pincers shown in FIG. 3.

The purpose of the sleeve 133 will be understood if the operation of the pincers for various possible positions of the sleeve are examined (FIGS. 3, 5 and 6). Note, firstly, that the sleeve may be brought to these positions by one or two fingers of the hand holding the pincers.

In FIG. 3, it can be seen that the abutment 128 of the auxiliary lever bears against the tubular member 122. Consequently, the pins 136, 119 and 124 are not in alignment but form a small angle $\alpha$ which signifies that a positive locking of the toggles 105, 116 is obtained.

In FIG. 5, the smooth portion 135 is brought in front of the abutment 128. Consequently the three pins 136, 119 and 124 are substantially in alignment (see straight line Y—Y) so that there is obtained a less rigid locking than in the case shown in FIG. 3 which is easier to release. Consequently, it is possible to choose the position of the sleeve 133 shown in FIG. 3 to grip parts subjected to vibrations (for example hammering) and the position shown in FIG. 5 for handling light and stable parts (for application of adhesive, counterboring etc...).

When the ridge 134 is brought in front of the abutment 128, the three pins 126, 119 and 124 cannot be brought into alignment so that the toggle cannot be put under tension or jammed. When gripping the part, these pins define an angle $\beta$ which, when it is chosen to be equal to the angle $\alpha$ shown in FIG. 3, enables the same gripping force to be exerted on the part but it is then impossible to lock the part definitively in the pincers. Consequently, as soon as the gripping force is released on the levers 101 and 117, the part is released and the pincers opens owing to the mere release of the toggle. Thus, it is possible to act on a part by successive energetic seizures and grippings (for example when screwing a nut on a screw) without ever locking the pincers on the part.

FIG. 6A shows a modification of the sleeve 133. In this modification, the sleeve 133A has a cylindrical portion 134A and a conical portion 135A which permits regulating the gripping force with a continuous adjustment. In this case, the sleeve may if desired serve to unlock the pincers after locking the toggle by making it slide in the direction of arrow *f* which moves the abutment 128 away.

In FIGS. 3 and 4, it can be seen that the jaw 105 has a transverse aperture having a cylindrical portion 138 and a conical portion 139 which is divergent toward the cylindrical portion so as to define a circular cutting edge. The conical portion 139 cooperates with the edge 140 of the corresponding opening 108 of the fork 104 so as to constitute a wire sectioning tool. Il is merely necessary to bring the passage 138 just below the edge 140, introduce the wire to be cut and close the pincers.

The edges of each one of the walls or branches of the fork 104 moreover have transverse grooves 141 which are adapted to cooperate with the chops 107 and 111 in the case where it is required to grip cylindrical parts (for example tubes). These parts may thus be gripped as three points on their periphery (chops 107 and 111 and grooves 141) approximately spaced 120° apart which, for example, avoids rendering the gripped part oval (see FIG. 7).

It has already been mentioned that the adjustable lever 116 may have graduations 131 and an index 132 to facilitate the adjustment of the length of the lever and consequently of the gripping force. It is advantageous to replace these indications by a positioning device operating without requiring that the user looks at the adjusting lever. If desired, this positioning device may be combined with the graduations.

Figure 8:
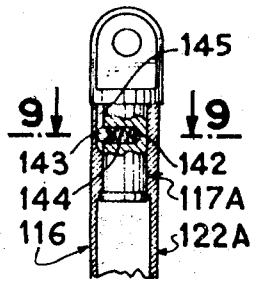
Figure 9:
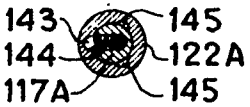

FIGS. 8 and 9 show a modification of such a positioning device. In this case, the adjustable lever 116 has as a first element a rod 117A which has in its cylindrical portion a blind transverse aperture 142 in which is disposed a ball 143 biased outwardly by a small spring 144. The tubular member 122A has one or more inner axial recesses 145, three in the illustrated embodiment, in which the ball 143 is capable of entering. It is then sufficient, in order to have an idea of the extension of the adjustable lever 116, that the user counts the number of clicking engagements of the ball in the axial recesses 145.

It may be advantageous to have available a rapid adjustment of the distance between the chops 107 and 111 and for this purpose the adjustable lever 116 may be provided with screwthreads having a rapid pitch. However, by choosing a rapid pitch there is a danger that, once the adjustment has been made, the lever 116 suddenly shortens on its own when putting the toggle under compression since reversibility of the screwthreads is then approached and the pincers would be useless for the purpose for which it is intended.

Figure 10:
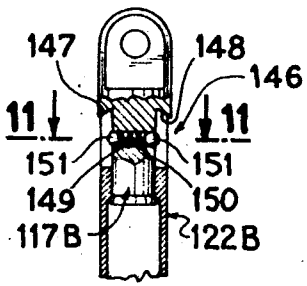
FIG. 8 to 11 are axial sectional views and a radial sectional views of two other modifications of the lever of adjustable length.
Figure 11:
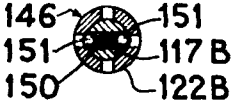

FIGS. 10 and 11 show a modification of the adjustable lever in which there are conciliated rapidity of adjustment and avoidance of the risk of a sudden shortening of the lever in the course of putting the toggle under compression. In this case the lever has a rapid pitch and includes a tubular member 122B which terminates toward the element in the form of a rod 117B in a portion 146 which is split axially in the several parts, each axial branch of this split portion 146 terminating in a beveled surface 147, whereas the rod 117B includes a complementary annular conical surface 148 which cooperates with the bevels of the split portion 146. This arrangement permits the adoption of a positioning device similar to that described hereinbefore with reference to FIGS. 8 and 9. For this purpose, the cylindrical portion of the rod 117B includes a radial aperture 149 in which are disposed a spring 150 and two balls 151 which are biased outwardly and cooperate with gaps between the branches of the split portion 146. Under the effect of the axial thrust exerted by the toggle, the conical surfaces 147 and 148 are applied against each other and radially compress the split portion 146. Consequently, after the toggle has been put under compression or stress, the tubular member 122B is prevented from rotating on the rod 117B, while there is ensured, before the toggle is put under stress, a possibility of a rapid adjustment of the lever.

Figure 12:
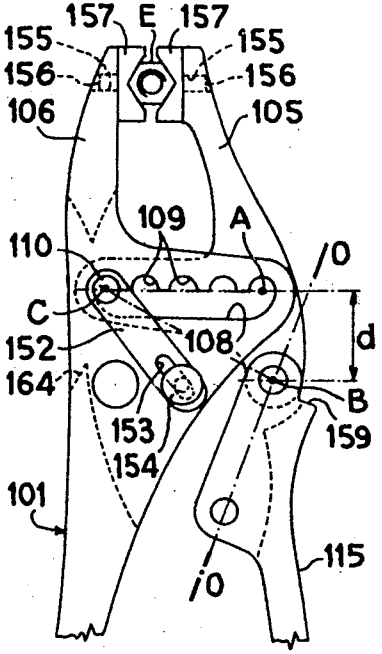
FIG. 12 is a partial plan view of another embodiment of the pincers according to the invention.

FIG. 12 shows another embodiment of the invention which is intended, if not to replace the springs 13 and 113, at least to add to the latter locking means for avoiding any accidental disengagement of the journal 110 from the notches 109. In this case, the journal 110 is integral with a connecting link 152 which extends along the body on main lever of the pincers and includes a longitudinal slot 153. In this slot there is inserted the screwthreaded shank of a locking screw 154 engaged in an aperture in the body or main lever of the pincers. Under these conditions, to modify the opening of the jaws it is sufficient to unscrew the screw 154, engage the journal 110 in another pair of notches 109 and once again screw the screw 154.

FIG. 12, also shows that the jaws 105 et 106 may be provided with transverse apertures 155 which are smooth or screwthreaded and are capable of receiving support pins 156 of special chops 157 which are adapted to the shape of the part to be gripped (in the present case a nut E). These chops 157 may be permanently fixed in a position or interchangeable, in which latter case a set of chops of different shapes may be provided.

Figure 13:
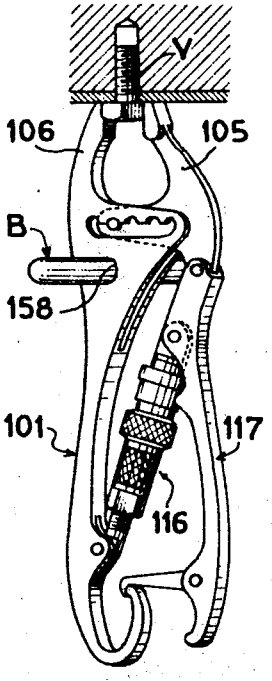

FIG. 13 shows another improvement which consists in providing in each wall of the for 104 of the pincers a transverse aperture 158, the two apertures defining a transverse passage through which may be inserted a bar, rod or other auxiliary member B which is adapted to apply to the pincers a rotating torque, for example when it is desired to screw a screw V. Note that irrespective of the extent of the opening of the pincers, the apertures 158 always clear the spring 113 or the pivotable jaw 105.

Figure 16:
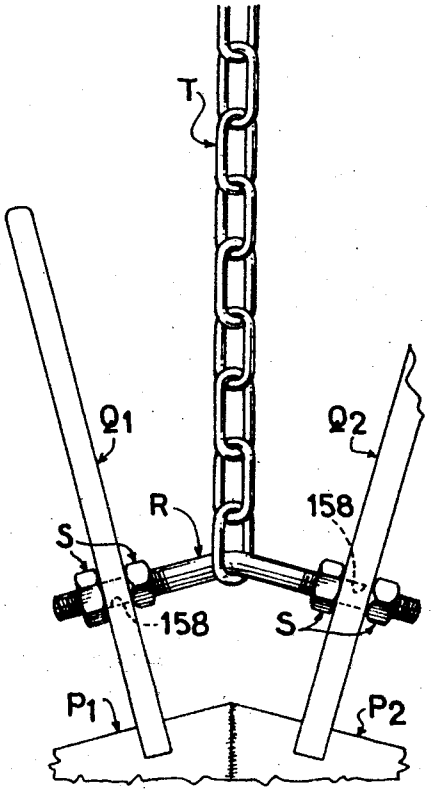
FIG. 13 to 16 show several ways of using the pincers according to the invention.

The apertures 158 may be employed in another manner as shown in FIG. 16. In this case, it concerns, for example, the welding together of two parts $P_1$ and $P_2$. Two gripping pincers $Q_1$ and $Q_2$ are then employed which are rendered integral with these parts. A screwthreaded connecting bar R is engaged in the apertures 158 in each pincers and secured to the pincers by nuts S. In the illustrated embodiment, the bar R is bent and this allows an inclined positioning of the parts $P_1$ and $P_2$ whose edges to be welded are oblique. The assembly thus constituted may be easily handled by means of a tackle, for example, through a chain T which is hooked to the connecting bar R. It will be understood this this is merely an example of utilisation which is described to illustrate the possibilities of the pincers according to the invention owing to the mere presence of the apertures 158 which do not in any manner affect the other operational possibilities of the pincers. Moreover, owing to these apertures 158, it is possible to secure a pincers directly to a bench or the like to maintain the parts in position in the course of machining. Note that the apertures 158 may have any shape such as a square, circular, hexagonal or other shape.

Figure 14:
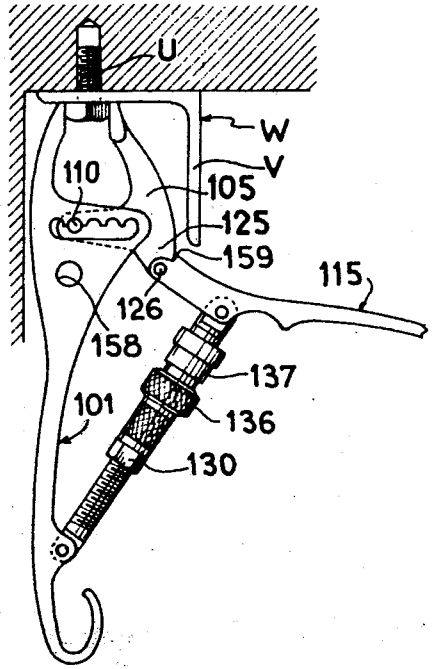

In FIG. 14, another improvement of the pincers according to the invention is illustrated which consists in providing on the auxiliary lever 115 a nose portion 159 provided on the exterior of this lever near the pivotal connection 126. This nose portion 159 is adapted to limit the angle of movement of the lever 115 with respect to the pivotable jaw so that a single lever can be formed when the nose portion is in abutment against the heel 125 of the pivotable jaw 105. The whole of this lever can then be made to pivot about the journal 110 by extension of the lever 116.

Thus it is possible to grip parts which are difficult to reach such as the screw U shown in FIG. 16 which is hidden by the flange V of an angle member W.

This screw would not be accessible in the absence of the heel 125 of the jaw 105. It can be seen that in this utilisation, the ring 136, the apertures 137 or the hexagonal portion 130 are particularly advantageous, since these elements enable a sufficient gripping force to be exerted on the adjustable lever 116 in the direction for extending it. Note also that the auxiliary lever 116 may be employed as a lever arm for rotating the pincers about the part to be gripped (screw U).

Figure 15:
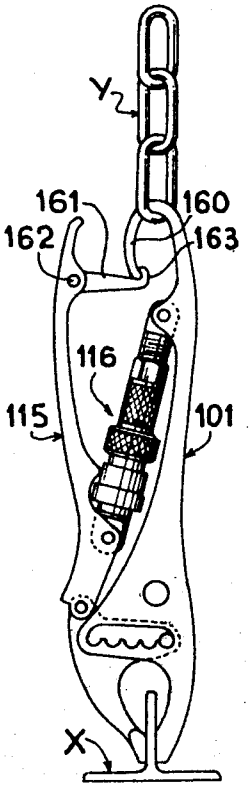

FIG. 15 shows another improvement which consists in providing the main lever 101 with a free curved end portion constituting a hook 160 which is forged with the rest of the lever for example. This hook permits employing the pincers as means for holding parts, such as the section member X, so as to suspend them from a chain Y of, for example, a tackle. This hook may be if desired associated with a withdrawable safety latch 161 which is pivoted at 162 to the auxiliary lever 115 and may be hooked by an end nose portion 163 onto the hook 160, owing to the elasticity of the levers of the pincers.

FIGS. 3, 7 and 12 show that the transverse space formed between the walls of the fork 104 is extended by an aperture or cavity 164 which is formed by a milling operation, this cavity permitting bringing the journal 110 and the corresponding end 105*a* of the jaw 105 flush with the outer edge of the lever 101 of the pincers. In this way, for a given overall size, it is possible to increase the number of notches 109 or reduce the transverse overall size and save material.

Owing to the improvements just described with reference to FIGS. 3 to 10, a number of advantages are obtained which concern both the manufacture, the cost, the universality and the convenience of handling of the pincers. It will be understood that all these improvements are not necessarily to be included in a single pincers, but it is possible to proceed in the course of the manufacture to a choice among the pincers in in accordance with the needs of utilisation.

Considerable advantages are afforded by the heel 125 of the jaw 105 which carries the pivot connecting the latter to the auxiliary lever 115. To illustrate these advantages, reference will be made in particular to FIG. 12, but it must be understood that the other illustrated embodiments permit the same advantages to be obtained so long as the jaw 105 has a heel 125.

In FIG. 12, reference character A designates the place of the pivotal connection of the pivotable lever to a pivotable jaw devoid of a heel. Further, reference characters B and C respectively designate the pivot pin 126 and the axis of the journal 110.

For similar dimensions of the pivotable jaw, it can be seen that the distance A–C is less than the distance B–C or, in other words, the lever arm with respect to the thrust line O—O, the toggle formed by the adjustable lever 115 and the pivotable jaw 105 is larger for a jaw with a heel than for a jaw without a heel. For a given overall size, it is therefore possible to increase the multiplication of the muscular effort on the part of the user.

Moreover, for a given strength the total thickness of the improved pincers may be smaller owing to the fact that the pivoting fork 126 is never disposed between the walls of the body of the pincers constituting the fork 104, even when the journal 110 is located in the first of the notches 109. The distance between the walls of the fork 104 may therefore be practically equal to the thickness of the pivotable jaw 105. This has an advantageous effect on the manufacturing tolerances which may be chosen independently of each other for a pincers with a jaw provided with a heel, whereas for a jaw without a heel, the tolerances of the fork of the main body, of the fork of the auxiliary lever, and of the thickness of the pivotable jaw are cumulative. Consequently owing to this improvement manufacture is made easier and therefore the cost of the pincers is reduced. There is also a greater ease of manufacture of the pin providing the pivotal connection 126. This may indeed project outwardly slightly and this avoids a machining necessary when the pivotal connection is afforded by a riveted pin.

Owing to the provision of the heel 125, it is also possible to obtain a displacement of the journal 110 in the direction for opening the pincers when the latter is adjusted before gripping. This displacement may indeed be obtained with the hand which holds the pincers by exerting opposing forces on the end of the levers 101 and 105, the pin 124 then constituting the axis of rotation of the assembly formed by the adjustable lever 126, the toggle part of the auxiliary lever 115, and the jaw 105.

Note that in all the embodiments described hereinbefore, the body or main lever of the pincers, the pivotable jaw and the auxiliary lever are constructed preferably from forged steel but it is also possible to manufacture them from another material and in particular a pressure cast aluminium alloy which has the advantage of rendering the pincers lighter and avoiding any subsequent machining and avoiding deterioration of the pincers when, in the course of welding operations, droplets of molten metal are projected onto the pincers which droplets would stick to a forged steel pincers (with aluminium the droplets would not stick).

Having now described my invention what I claim as new and desire to secure by letters patent is:

1. A gripping pincers of the vice-pincers type, the pincers comprising:

a main lever of forged steel having a milled fork, the milled fork including an elongated opening on both sides thereof having a plurality of arcuate notches therealong, a first fixed jaw integral with said main lever, a first chop integral with said first fixed jaw and formed at one end thereof.

a second jaw of forged steel having a T shape and mounted on a first part of said main lever for pivotal motion thereon, a journal mounted on the base portion of the T shaped second jaw, wherein said journal is capable of engaging a selected one of said arcuate notches for pivotal motion thereon and whereby the transverse distance between the first and second jaw may be adjusted, a second chop mounted on a first cross arm bar of said T shaped second jaw, a toggle device connecting said pivotable jaw to another part of said main lever, the toggle device comprising an auxiliary lever of forged steel pivoted to the second cross arm bar of said T shaped second jaw wherein the journal of said second jaw and the elongated opening of the fork is between the second chop and the pivot of said second cross arm in all relative positions of said first and second jaws, the toggle device performing the function of a lever for locking the pincers, an adjustable lever of changeable length having one end pivoted to a forked lug integral with said auxiliary lever and another end pivoted to a forked lug integral with said main lever, said adjustable lever comprising an elongated tubular element having at either end a set of internal threads, the threads of one set being pitched oppositely to the threads of the other, a first threaded rod attached at one end thereof by a pivot to the forked lug of said main lever and engaging at the other end thereof by means of threads one set of the internal threads of said tubular element, and a second threaded rod attached at one end thereof by a pivot to the forked lug of said auxiliary lever and engaging at the other end thereof by means of threads the other set of internal threads of said tubular element, whereby rotation of the tubular element relative to the first and second threaded rods causes a change of length of the adjustable lever, a fixed abutment integrally formed on said auxiliary lever, said abutment contacting the tubular portion of the adjustable lever whereby the approach of the auxiliary lever toward the main lever is limited.

a stressed spring, a projection integral with said second jaw adjacent to said journal, and a pin mounted on said main lever between said elongated opening and the forked lug of said main lever, wherein said stressed spring is attached to said projection and said pin and whereby said spring urges said journal into engagement with a selected one of said notches and biases said two jaws into an opened position, and a transverse aperture located in said main lever and adapted to receive a lever perpendicular to said main lever for applying a driving torque to the pincers.

2. A pincers as in claim 1 further including regulating means comprising a sleeve slidably mounted on said adjustable lever, said sleeve having an outside diameter which varies axially of said sleeve, said sleeve located on said adjustable lever so as to be contacted by said abutment whereby the gripping force of the jaws may be varied and the locking of the jaws by the toggle may be prevented.

3. A pincers as claimed in claim 1 further comprising locking means for maintaining said journal in any selected one of said notches, said locking means for said journal comprising a link pivoted to said journal and having an elongated opening, and a locking screw engaged transversally in said main lever and extending through said elongated opening for maintaining said link in position.

4. A pincers as in claim 1 further comprising a hook portion formed on the end of said main lever remote from said first fixed jaw and a safety latch pivoted to said auxiliary lever, said safety latch being elastically cooperative with said hook portion due to the elasticity of the levers of said pincers.

* * * * *